US008805233B2

(12) United States Patent
Akamatsu

(10) Patent No.: US 8,805,233 B2
(45) Date of Patent: Aug. 12, 2014

(54) CLEANING DEVICE AND IMAGE FORMING APPARATUS

(75) Inventor: Hiroaki Akamatsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 213 days.

(21) Appl. No.: 13/545,659

(22) Filed: Jul. 10, 2012

(65) Prior Publication Data

US 2013/0251394 A1 Sep. 26, 2013

(30) Foreign Application Priority Data

Mar. 23, 2012 (JP) ..... 2012-066638

(51) Int. Cl.
*G03G 21/00* (2006.01)

(52) U.S. Cl.
USPC ..... 399/102; 399/350; 399/351

(58) Field of Classification Search
CPC ..... G03G 21/0029
USPC ..... 399/102, 350, 351
See application file for complete search history.

(56) References Cited

U.S. PATENT DOCUMENTS 5,774,765 A * 6/1998 Hirota et al. ..... 399/102
6,640,081 B2 * 10/2003 Sato ..... 399/350
6,658,223 B2 * 12/2003 Nishimura et al. ..... 399/102
6,895,198 B2 * 5/2005 Thompson et al. ..... 399/102
2009/0317124 A1 * 12/2009 Iwamoto et al. ..... 399/102

FOREIGN PATENT DOCUMENTS

JP 07-181857 A 7/1995
JP 2003-316222 A 11/2003

* cited by examiner

*Primary Examiner* — Susan Lee
(74) *Attorney, Agent, or Firm* — Sughrue Mion, PLLC

(57) ABSTRACT

A cleaning device includes a developer removing member with one long-side edge thereof coming into contact with an image carrier, a supporting member supporting the developer removing member such that the developer removing member extends beyond the supporting member on a side thereof having the one long-side edge, a developer collecting member having an opening for collecting developer residues and configured such that the one long-side edge of the developer removing member is positioned in a short-side central portion of the opening and portions defining one long-side edge and two short-side edges of the opening face a combination of the supporting member and the developer removing member, a sealing member provided between the combination and the portions defining the one long-side edge and the two short-side edges of the opening, and an adhesion preventing member interposed between the sealing member and the developer removing member.

5 Claims, 8 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2012-066638 filed Mar. 23, 2012.

BACKGROUND

Technical Field

The present invention relates to a cleaning device and an image forming apparatus.

SUMMARY

According to an aspect of the invention, there is provided a cleaning device including a developer removing member that has a substantially long plate shape, one edge of the developer removing member that extends in a long-side direction coming into contact with a surface of an image carrier, the developer removing member removing developer residues from the surface of the image carrier while the image carrier is rotating in a short-side direction; a supporting member that is in contact with a surface of the developer removing member opposite another surface of the developer removing member that faces the image carrier, the supporting member supporting the developer removing member in the long-side direction such that the developer removing member extends beyond the supporting member on a side thereof having the one edge; a developer collecting member that has an opening, the opening being substantially long in the long-side direction with a smaller length in the long-side direction than the developer removing member, the developer collecting member being configured such that the one edge of the developer removing member is positioned in a central portion of the opening in the short-side direction and such that portions defining one edge of the opening extending in the long-side direction and two edges of the opening extending in the short-side direction, respectively, face a combination of the supporting member and the developer removing member, the developer collecting member collecting, via the opening, the developer residues that have been removed from the image carrier; a sealing member that is provided between the combination of the supporting member and the developer removing member and the portions defining the one edge of the opening extending in the long-side direction and the two edges of the opening extending in the short-side direction, the sealing member sealing any gaps produced therebetween; and an adhesion preventing member provided in each of the portions defining the two respective edges of the opening extending in the short-side direction, the adhesion preventing member being interposed between the sealing member and the developer removing member and preventing the developer removing member and the sealing member from adhering to each other.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail with reference to the accompanying drawings. The present invention is not limited to the following exemplary embodiments, and many modifications can be made to the exemplary embodiments within the scope of the invention. The drawings referred to herein are only for describing the following exemplary embodiments, and elements illustrated therein are scaled arbitrarily.

First Exemplary Embodiment

Image Forming Apparatus 100

Figure 1:
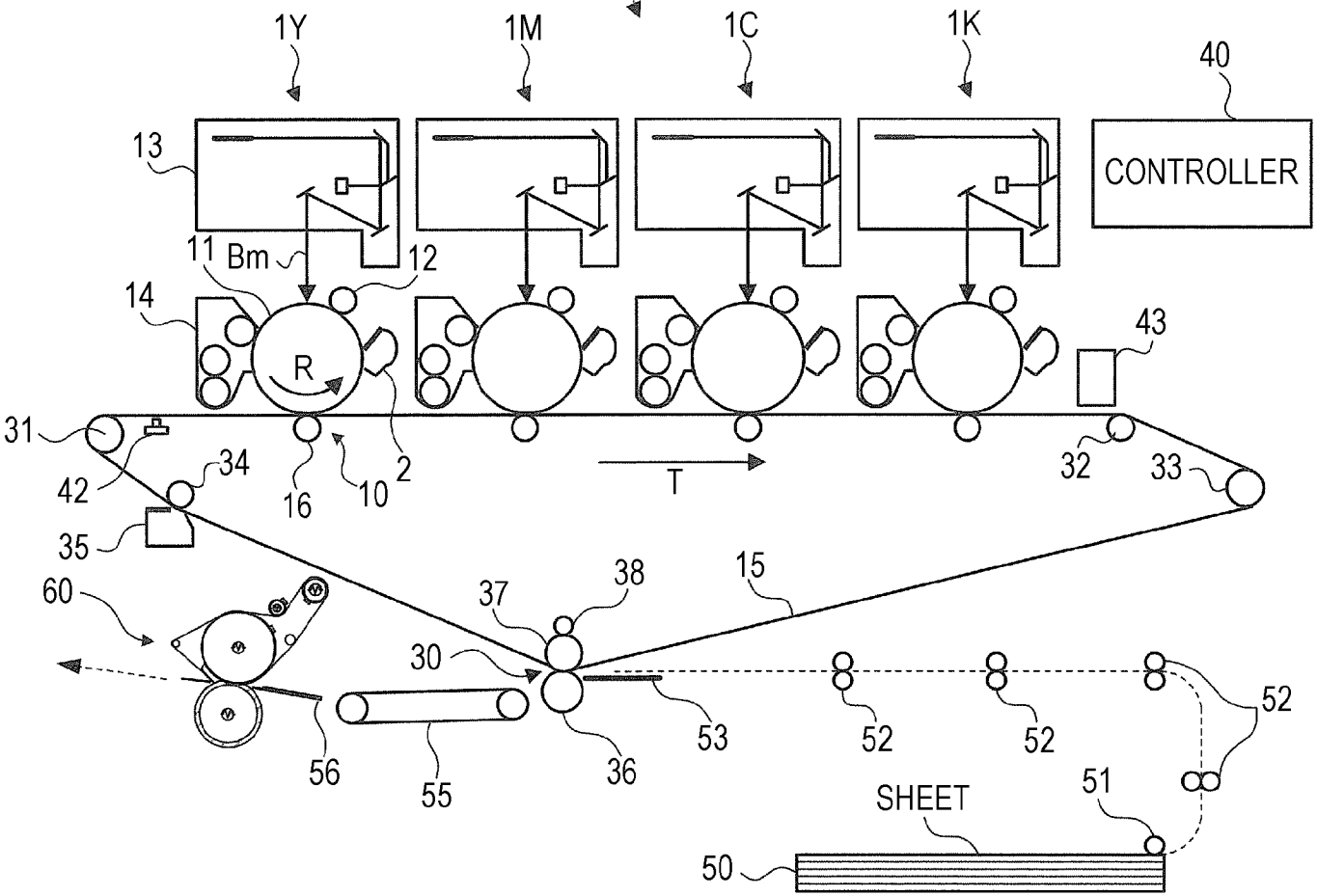
FIG. 1 illustrates an exemplary configuration of an image forming apparatus according to a first exemplary embodiment of the present invention.

FIG. 1 illustrates an exemplary configuration of an image forming apparatus 100 according to a first exemplary embodiment of the present invention. The first exemplary embodiment concerns a case where the image forming apparatus 100 is of a so-called tandem type employing an intermediate transfer method. The image forming apparatus 100 illustrated in FIG. 1 includes plural image forming units 1Y, 1M, 1C, and 1K that are collectively regarded as a toner-image-forming section and electrophotographically form individual toner images in respectively different colors. The image forming apparatus 100 further includes first transfer portions 10 that sequentially transfer (first-transfer) the toner images in the respectively different colors formed by the image forming units 1Y, 1M, 1C, and 1K to an intermediate transfer belt 15, which is an exemplary image carrier, and a second transfer portion 30 that transfers (second-transfers) the toner images having been transferred to and superposed on the intermediate transfer belt 15 to a sheet, which corresponds to a recording material (recording sheet), at a time. The first transfer portions 10 and the second transfer portion 30 are collectively regarded as a transfer section. The image forming apparatus 100 further includes a fixing device 60 that is regarded as a fixing section and fixes the second-transferred images on the sheet, and a controller 40 that controls operations of the foregoing elements.

As illustrated in FIG. 1, the image forming units 1Y, 1M, 1C, and 1K each include a photoconductor drum 11 that is an exemplary image carrier and rotates in a direction of arrow R, a charging device 12 that is an exemplary charging member and charges the photoconductor drum 11, a laser exposure device 13 (an exposure beam is denoted by reference characters Bm in FIG. 1) that is an exemplary exposure member and writes an electrostatic latent image on the photoconductor drum 11, and a development device 14 that is an exemplary development member, contains a toner having a corresponding one of the different colors, and visualizes the electrostatic latent image on the photoconductor drum 11 with the toner. Furthermore, the image forming units 1Y, 1M, 1C, and 1K each include a first transfer roller 16 that transfers a corresponding one of the toner images in the respective colors formed on the photoconductor drum 11 to the intermediate transfer belt 15 at a corresponding one of the first transfer portions 10, and a cleaning device (drum cleaner) 2 that is an exemplary cleaning member and removes toner residues from the photoconductor drum 11. The image forming units 1Y, 1M, 1C, and 1K for yellow (Y), magenta (M), cyan (C), and black (K) are arranged in a line in that order from the upstream side along the intermediate transfer belt 15.

The intermediate transfer belt 15 is driven to rotate around several rollers in a direction of arrow T illustrated in FIG. 1. The several rollers include a driving roller 31 that drives the intermediate transfer belt 15 to rotate, a supporting roller 32 that supports the intermediate transfer belt 15, a tension roller 33 that gives a tension to the intermediate transfer belt 15 and prevents the meandering of the intermediate transfer belt 15, a backup roller 37 that is provided at the second transfer portion 30, and a cleaning backup roller 34 that is provided at a cleaning portion and scrapes toner residues from the intermediate transfer belt 15.

The first transfer portions 10 each include the first transfer roller 16, which is provided across the intermediate transfer belt 15 from the photoconductor drum 11. A voltage (first transfer bias) having a polarity opposite to that (a negative polarity) of a charge given to the toner is applied to the first transfer roller 16. Then, the toner images on the respective photoconductor drums 11 are sequentially electrostatically attracted to the intermediate transfer belt 15. Thus, the toner images are superposed one on top of another on the intermediate transfer belt 15.

The second transfer portion 30 includes a second transfer roller (transfer body) 36 provided on the outer side of the intermediate transfer belt 15 on which the toner images are formed, the backup roller 37 functioning as a counter-electrode for the second transfer roller 36 and provided on the inner side of the intermediate transfer belt 15, and a metal power feeding roller 38 provided in contact with the backup roller 37 and configured to apply a second transfer bias thereto.

An intermediate-transfer-belt cleaner 35 that removes toner residues and paper lint remaining on the intermediate transfer belt 15 after the second transfer is provided at a position of the intermediate transfer belt 15 on the downstream side with respect to the second transfer portion 30 in such a manner as to be movable to and away from the intermediate transfer belt 15. A reference sensor (home position sensor) 42 that generates a reference signal for notifying the timing of image formation to be performed by the image forming units 1Y, 1M, 1C, and 1K is provided on the upstream side of the image forming unit 1Y provided for yellow (Y). An image density sensor 43 that is responsible for image quality adjustment is provided on the downstream side of the image forming unit 1K provided for black (K). The reference sensor 42 recognizes a mark provided on the inner side of the intermediate transfer belt 15 and generates a reference signal. The controller 40 receives the reference signal and issues an instruction on the basis of the reference signal. Then, the image forming units 1Y, 1M, 1C, and 1K start image formation.

A recording sheet transport system according to the first exemplary embodiment includes a sheet container 50 that contains sheets, a pickup roller 51 that picks up and transports one of the sheets in the sheet container 50, transport rollers 52 that transport the sheet, a transport path 53 that guides the sheet to the second transfer portion 30, a transport belt 55 that transports the sheet that has been subjected to second transfer performed by the second transfer roller 36 toward the fixing device 60, and a fixing entrance guide 56 that guides the sheet into the fixing device 60.

A basic image forming process performed by the image forming apparatus 100 will now be described.

In the image forming apparatus 100 illustrated in FIG. 1, a piece of image data that is output from a device (not illustrated), such as an image reading device (scanner) or a personal computer (PC), is processed by an image processing device (not illustrated). Subsequently, the image forming units 1Y, 1M, 1C, and 1K perform image formation. The image processing device performs, on a piece of reflectance data that is input thereto, image processing operations, including image editing, such as shading correction, misregistration correction, brightness/color-space conversion, gamma correction, frame erasing, color editing, and image moving. The image processing device converts the piece of image data processed as described above into four pieces of color tone data corresponding to the colors of Y, M, C, and K and outputs the four pieces of color tone data to the respective laser exposure devices 13.

The laser exposure devices 13 apply exposure beams Bm emitted from, for example, semiconductor lasers to the photoconductor drums 11 in the respective image forming units 1Y, 1M, 1C, and 1K in accordance with the pieces of color tone data that are input thereto. After the charging devices 12 charge the surfaces of the photoconductor drums 11 in the respective image forming units 1Y, 1M, 1C, and 1K, the laser exposure devices 13 perform scan-exposure on the surfaces of the photoconductor drums 11, whereby electrostatic latent images are formed on the photoconductor drums 11, respectively. The electrostatic latent images are developed into toner images in the colors of Y, M, C, and K by the image forming units 1Y, 1M, 1C, and 1K, respectively.

Subsequently, a voltage (first transfer bias) having a polarity opposite to that (a negative polarity) of the charged toners is applied to a base member of the intermediate transfer belt 15 via the first transfer rollers 16 provided in the respective first transfer portions 10, where the photoconductor drums 11 are in contact with the intermediate transfer belt 15. Thus, the toner images on the photoconductor drums 11 are first-transferred to the surface of the intermediate transfer belt 15 in such a manner as to be sequentially superposed one on top of another.

After the toner images are sequentially first-transferred to the surface of the intermediate transfer belt 15, the intermediate transfer belt 15 rotates and transports the toner images to the second transfer portion 30. The recording sheet transport system feeds a sheet from the sheet container 50 by rotating the pickup roller 51 in accordance with the timing of transport of the toner images to the second transfer portion 30. The sheet fed by the pickup roller 51 is transported by the transport rollers 52, advances along the transport path 53, and reaches the second transfer portion 30. Before reaching the second transfer portion 30, the sheet is temporarily stopped by registration rollers (not illustrated). The registration rollers are rotated in accordance with the timing of rotation of the intermediate transfer belt 15 carrying the toner images, whereby the sheet and the toner images are registered with respect to each other.

In the second transfer portion 30, the second transfer roller 36 is pressed against the backup roller 37 with the intermediate transfer belt 15 interposed therebetween, whereby the toner images, which are yet to be fixed, on the intermediate transfer belt 15 are electrostatically transferred at a time to the sheet that is nipped between the intermediate transfer belt 15 and the second transfer roller 36.

Subsequently, the sheet having the toner images electrostatically transferred thereto is released from the intermediate transfer belt 15 by the second transfer roller 36 and is then transported to the transport belt 55 provided on the downstream side in the direction of sheet transport with respect to the second transfer roller 36. The transport belt 55 transports the sheet to the fixing device 60. The fixing device 60 processes the yet-to-be-fixed toner images on the sheet with heat and pressure, thereby fixing the toner images on the sheet. The sheet now having the fixed toner images is transported to an output portion of the image forming apparatus 100.

After the above image transfer to the sheet is complete, toner residues on the intermediate transfer belt 15 are transported to the cleaning portion with the rotation of the intermediate transfer belt 15. Then, the toner residues are removed from the intermediate transfer belt 15 by the cleaning backup roller 34 and the intermediate-transfer-belt cleaner 35.

In this specification, the term "toner" is also referred to as "developer".

Cleaning Device 2

Figure 2:
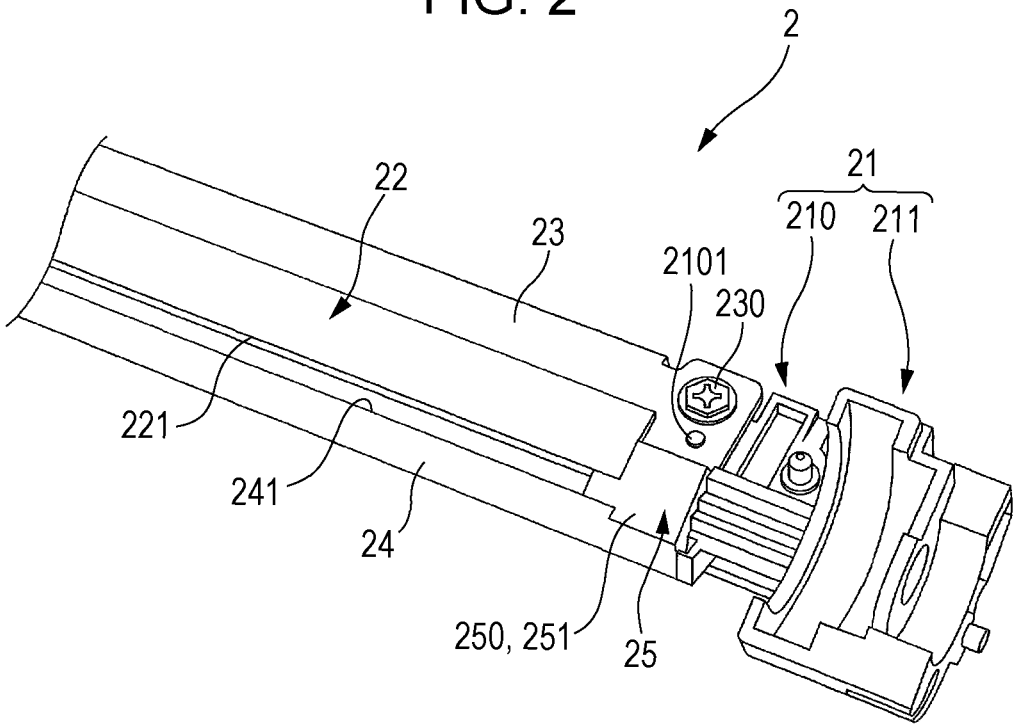
FIG. 2 is a front view illustrating part of a cleaning device.

FIG. 2 is a front view illustrating part of the cleaning device 2.

FIG. 2 illustrates an end of the cleaning device 2, included in the image forming apparatus 100 illustrated in FIG. 1, seen from the side of the development device 14 over the photoconductor drum 11. Since the cleaning device 2 is bilaterally symmetric, only the end illustrated in FIG. 2 will be discussed hereinafter.

The cleaning device 2 includes a cleaning device frame 21 as an exemplary developer collecting member, a cleaning blade 22 as an exemplary developer removing member, a cleaning-blade-supporting plate 23 as an exemplary supporting member, a sheet member 24, and a felt member 25. Although not illustrated in FIG. 2, the cleaning device 2 further includes a sealant 20 as an exemplary sealing member and a film member 27 as an exemplary adhesion preventing member.

The cleaning blade 22 is a long plate-shaped or substantially long plate-shaped elastic member made of, for example, polyurethane. An edge 221 of the cleaning blade 22 comes into contact with the surface of the photoconductor drum 11 and removes toner residues (developer residues) from the photoconductor drum 11.

The cleaning-blade-supporting plate 23 is a metal plate member and supports the cleaning blade 22. The cleaning-blade-supporting plate 23 is fixed to the cleaning device frame 21 with a screw nut 230. The cleaning-blade-supporting plate 23 and the cleaning blade 22 are bonded together with hot-melt adhesive or the like.

The cleaning device frame 21 includes a body 210 to which the cleaning-blade-supporting plate 23 supporting the cleaning blade 22 is screwed, and a holding portion 211 at which a corresponding one of two ends of the photoconductor drum 11 is rotatably held.

The cleaning device frame 21 has an inlet 210*a* (see FIG. 4 to be referred to below) having a long narrow or substantially long narrow shape extending in a long-side direction thereof. The inner side of the inlet 210*a* provides a recessed space as a toner collecting portion in which toner residues that have been removed from the surface of the photoconductor drum 11 are collected.

The cleaning-blade-supporting plate 23 supporting the cleaning blade 22 is screwed at each longitudinal end of the cleaning device frame 21 that define the inlet 210*a*.

The body 210 has a boss 2101 used in positioning the cleaning-blade-supporting plate 23. Hereinafter, an expression "the photoconductor drum 11 is attached to the holding portion 211 of the cleaning device frame 21" will be used as a matter of convenience.

The cleaning-blade-supporting plate 23 supporting the cleaning blade 22 is screwed to the cleaning device frame 21 with the sealant 20 (see FIG. 5 to be referred to below) interposed therebetween, as described separately below. The sealant 20 is applied to plural peripheral sides (peripheral sides A, B, and C described separately below) of the cleaning device frame 21 that define the inlet 210*a*. Therefore, toner residues collected in the recessed space are prevented from leaking via any gaps produced between the cleaning device frame 21 and the cleaning-blade-supporting plate 23.

The felt member 25 includes a felt layer 251 forming the outer surface and an elastic layer 252 supporting the felt layer 251 (see FIGS. 6B and 7 to be referred to below). The elastic layer 252 has such a thickness as to be squeezed by the photoconductor drum 11 when the photoconductor drum 11 is attached to the holding portion 211 of the cleaning device frame 21. Therefore, the felt layer 251 comes into close contact with the photoconductor drum 11, preventing the leakage of toner residues.

The felt member 25 includes a projection 250 projecting toward the longitudinal center of the cleaning device 2. Referring to FIG. 2, a side of the projection 250 and a side of a region of the felt member 25 excluding the projection 250 that is nearest to the cleaning blade 22 align with a corner of the cleaning blade 22. Although the felt layer 251 is employed herein as a member that is to be in contact with the photoconductor drum 11, the member that is to be in contact with the photoconductor drum 11 is not limited to a felt member, as long as the member has a small coefficient of friction.

The sheet member 24 is pasted to the other long side of the cleaning device frame 21 that defines the inlet 210*a* with, for example, double-sided adhesive tape 26. The sheet member 24 is made of polyurethane. An edge 241 of the sheet member 24 comes into contact with the photoconductor drum 11 that is attached to the holding portion 211 of the cleaning device frame 21. Toner residues are confined between the edge 221 of the cleaning blade 22 and the edge 241 of the sheet member 24 and are thus prevented from leaking.

Figure 3:
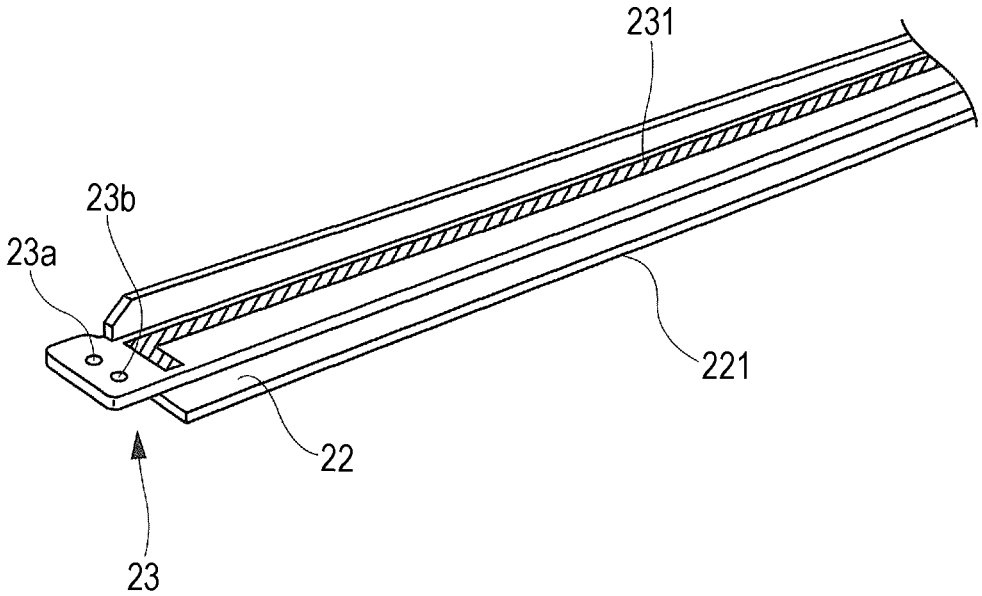
FIG. 3 illustrates a cleaning-blade-supporting plate supporting a cleaning blade.

FIG. 3 illustrates the cleaning-blade-supporting plate 23 supporting the cleaning blade 22 in a state before screwed to the cleaning device frame 21 of the cleaning device 2. In FIG. 3, a side of the cleaning-blade-supporting plate 23 that faces the cleaning device frame 21 is oriented upward. One of the long sides of the cleaning blade 22 resides on the cleaning-blade-supporting plate 23. The cleaning blade 22 extends beyond the cleaning-blade-supporting plate 23 on the other long side thereof.

Referring to FIG. 3, the cleaning-blade-supporting plate 23 has a hole 23*a* into which the screw nut 230 illustrated in FIG. 2 is to be inserted, and a hole 23*b* into which the boss 2101 of the cleaning device frame 21 illustrated in FIG. 2 is to be inserted.

The cleaning-blade-supporting plate 23 includes a rough surface portion 231 that is to be in contact with the peripheral sides (peripheral sides A, B, and C illustrated in FIG. 4 to be referred to below) of the cleaning device frame 21 that define the inlet 210*a*. The rough surface portion 231, the hatched part in FIG. 3, has a higher ten-point height of irregularities Rz than the peripheral sides defining the inlet 210*a*. When the cleaning-blade-supporting plate 23 is screwed to the cleaning device frame 21, the rough surface portion 231 comes into contact with the sealant 20 (see FIGS. 6A and 6B to be referred to below) provided on the peripheral sides of the cleaning device frame 21 that define the inlet 210*a*.

The ten-point height of irregularities Rz of the rough surface portion 231 of the cleaning-blade-supporting plate 23 that is to be in contact with the sealant 20 is set higher than that of the peripheral sides of the cleaning device frame 21 that define the inlet 210*a*. Furthermore, the rough surface portion 231 is brought into contact with the sealant 20 before the sealant 20 is solidified. Therefore, when the cleaning device 2 that has been used is disassembled and the cleaning-blade-supporting plate 23 is detached from the cleaning device frame 21, the sealant 20 remains adhered to the cleaning-blade-supporting plate 23, not to the cleaning device frame 21.

Figure 4:
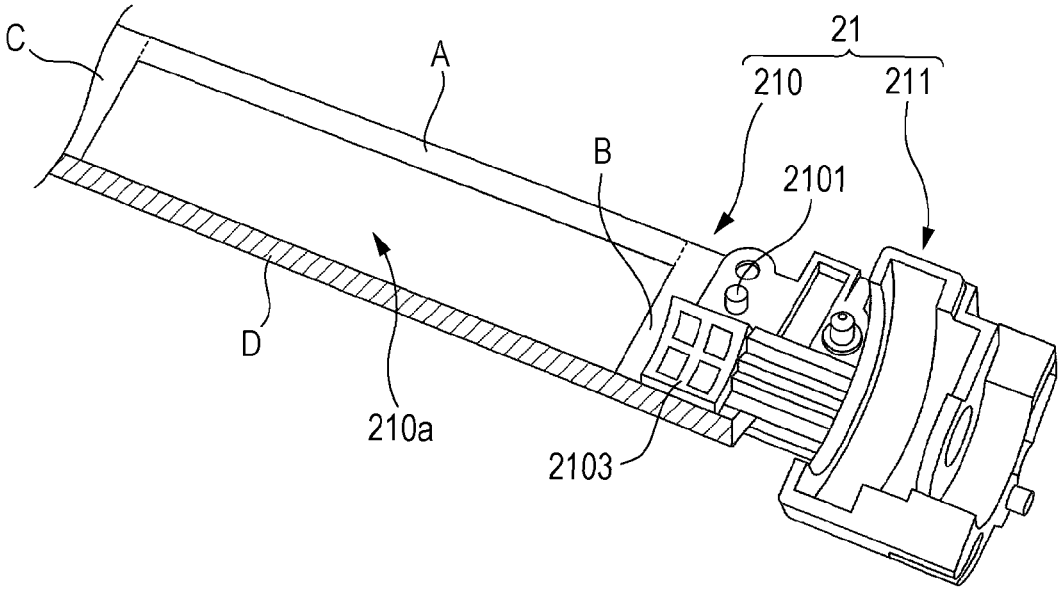
FIG. 4 illustrates a cleaning device frame.

FIG. 4 illustrates the cleaning device frame 21. The cleaning device frame 21 illustrated in FIG. 4 is in a state before the cleaning-blade-supporting plate 23, the felt member 25, and the sheet member 24 are attached to the body 210, that is, in a state where the inlet 210*a* of the recessed space in which toner residues are to be collected is exposed. In FIG. 4, the peripheral sides that define the inlet 210*a*, which has a rectangular shape, are denoted by reference characters A to D. The reference characters are given as a matter of convenience for the following description and are not actually given to the cleaning device frame 21.

The term "peripheral side" refers to each of regions of the outer surface of the cleaning device frame 21 that extend around and along the inlet 210*a*.

The peripheral side A forms one of the long sides that define the recessed space and resides on one side in a direction of movement of the surface of the photoconductor drum 11 (the direction of arrow R illustrated in FIG. 1). The cleaning-blade-supporting plate 23 is attached to the peripheral side A. The peripheral side D forms the other long side defining the recessed space. The sheet member 24 is pasted to the peripheral side D.

The peripheral side B and the peripheral side C form two respective sides defining the inlet 210*a* of the recessed space in the axial direction intersecting the direction of movement of the surface of the photoconductor drum 11 (the direction of arrow R illustrated in FIG. 1).

Figure 6A:
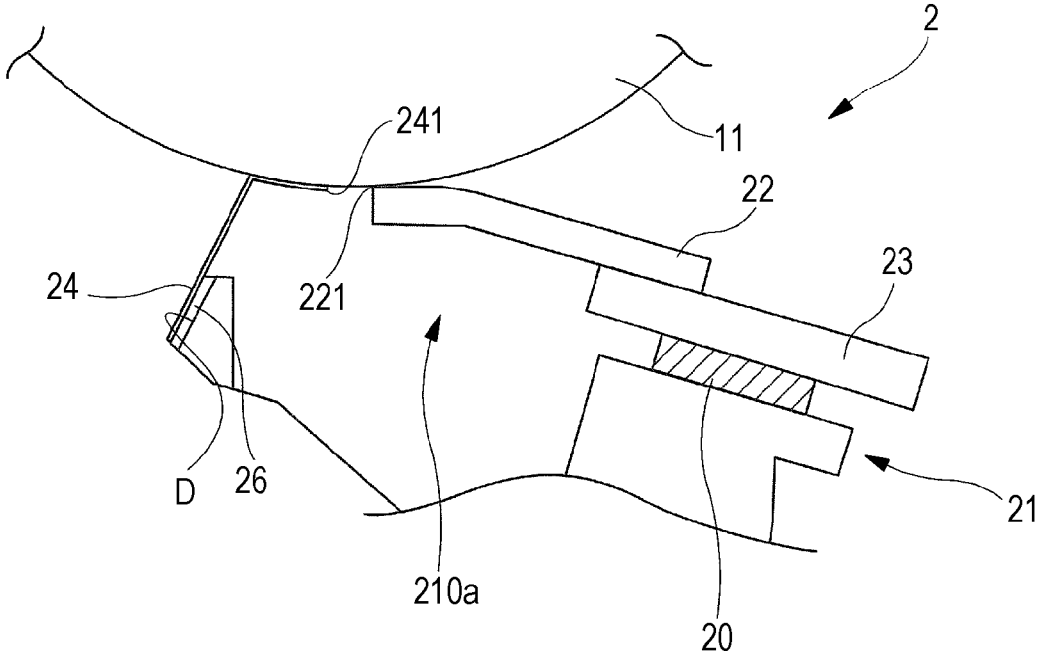
FIGS. 6A and 6B each illustrate a state where a photoconductor drum is attached to a holding portion of the cleaning device frame according to the first exemplary embodiment.

The peripheral sides A and D are flat. As illustrated in FIGS. 6A and 6B to be also referred to below, since the cleaning-blade-supporting plate 23 has a certain thickness, the peripheral sides B and C have steps.

The sealant 20 is applied to the peripheral side A, the peripheral side B, and the peripheral side C.

The sealant 20 is, for example, thermoplastic elastomer or the like. Before the sealant 20 applied to the peripheral sides A, B, and C is cured, the cleaning-blade-supporting plate 23 and other components are screwed to the cleaning device frame 21. Hence, the sealant 20 is squeezed and spreads between the cleaning device frame 21 and the cleaning-blade-supporting plate 23 and fills the gap therebetween, preventing the leakage of toner residues.

The sealant 20 retains its elasticity, viscosity, and adhesiveness even after cured.

Figure 5:
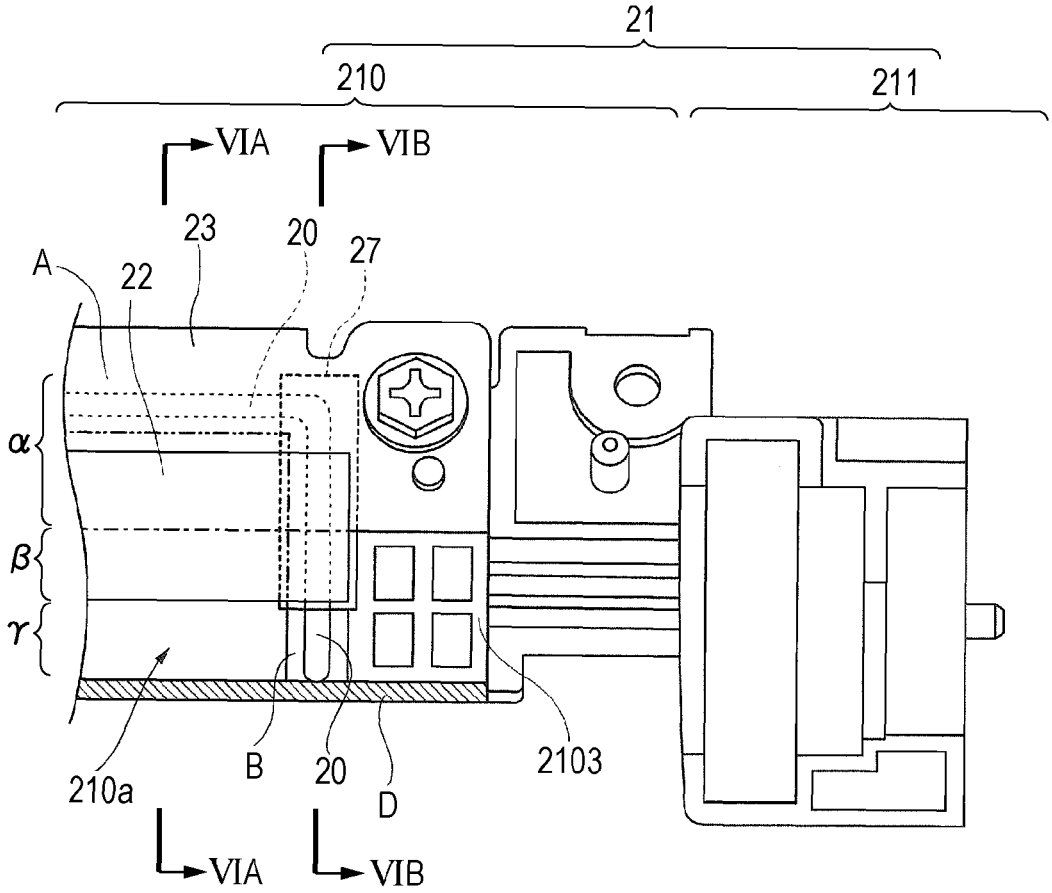
FIG. 5 is an enlarged view of the cleaning device according to the first exemplary embodiment.

FIG. 5 is an enlarged view of the cleaning device 2 according to the first exemplary embodiment. In FIG. 5, the cleaning-blade-supporting plate 23 having the cleaning blade 22 bonded therewith is attached to the cleaning device frame 21. The edge of the inlet 210*a* provided in the cleaning device frame 21 that is behind the cleaning blade 22 and the cleaning-blade-supporting plate 23 is represented by a dash-dot-dot line. The edge of the cleaning-blade-supporting plate 23 that is behind the cleaning blade 22 is represented by a dash-dot line. A portion of the sealant 20 extending over the peripheral sides A and B that is behind the cleaning blade 22 and the cleaning-blade-supporting plate 23 is represented by a dotted line. A portion of the film member 27 that is behind the cleaning blade 22 and the cleaning-blade-supporting plate 23 is represented by a broken line.

As illustrated in FIG. 5, the sealant 20 is provided over the peripheral side A and the peripheral side B (including the peripheral side C, which is not illustrated in FIG. 5). The cleaning-blade-supporting plate 23 having the cleaning blade 22 bonded therewith is attached to the cleaning device frame 21 with the sealant 20 interposed therebetween.

The film member 27 is provided on the peripheral side B in such a manner as to be interposed between the sealant 20 and a combination of the cleaning-blade-supporting plate 23 and the cleaning blade 22.

The cleaning blade 22 extends beyond the edge of the cleaning-blade-supporting plate 23. Therefore, in a region $\alpha$ on the peripheral side B, the film member 27 resides between the sealant 20, provided on the cleaning device frame 21, and the cleaning-blade-supporting plate 23. Meanwhile, in a region $\beta$ on the peripheral side B, the film member 27 resides between the sealant 20, provided on the cleaning device frame 21, and the cleaning blade 22.

The film member 27 may be made of polyethylene or the like that is flexible and, as described separately below, only needs to reside between the sealant 20 and the cleaning blade 22 and to prevent the cleaning blade 22 from adhering to the sealant 20.

In a region $\gamma$ on the peripheral side B, the projection 250 of the felt member 25 is made to adhere to the sealant 20 provided on the cleaning device frame 21.

Figure 6B:
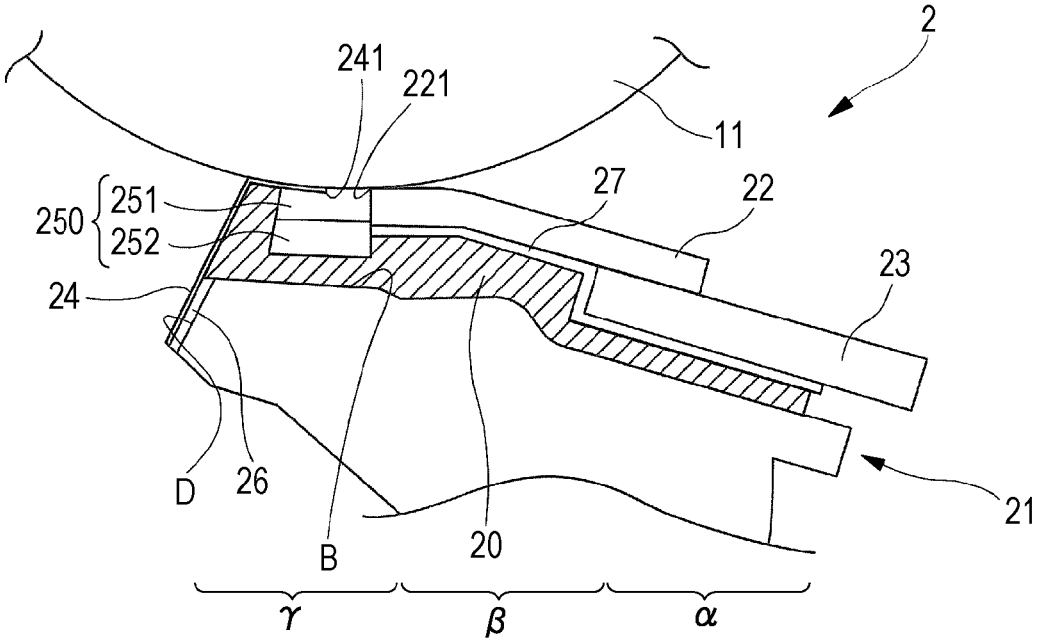

FIGS. 6A and 6B each illustrate a state where the photoconductor drum 11 is attached to the holding portion 211 (see FIG. 4) of the cleaning device frame 21 according to the first exemplary embodiment. FIG. 6A is a sectional view taken along line VIA-VIA illustrated in FIG. 5. FIG. 6B is a sectional view taken along line VIB-VIB illustrated in FIG. 5.

In the section illustrated in FIG. 6A that is taken along line VIA-VIA illustrated in FIG. 5, i.e., in a region where the cleaning blade 22 faces the inlet 210*a*, the cleaning blade 22 is pressed against the photoconductor drum 11 and the edge 221 of the cleaning blade 22 is in contact with the photoconductor drum 11.

In the section illustrated in FIG. 6B that is taken along line VIB-VIB illustrated in FIG. 5, i.e., in a region where the cleaning blade 22 resides on the peripheral side B, the film member 27 is interposed between the cleaning blade 22 and the sealant 20. Therefore, the sealant 20 having adhesiveness holds the film member 27 by adhering thereto. Hence, the cleaning blade 22 is pressed against the photoconductor drum 11 with its own elasticity, and the edge 221 of the cleaning blade 22 comes into contact with the photoconductor drum 11.

Thus, production of any gaps between the photoconductor drum 11 and the cleaning blade 22 is prevented.

Figure 7:
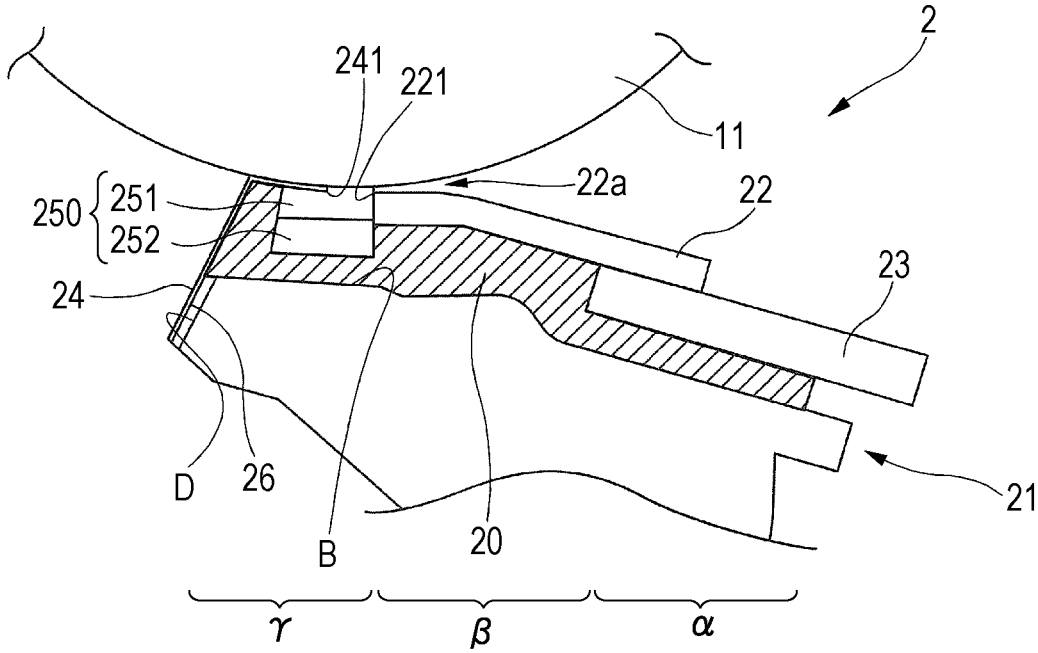
FIG. 7 illustrates a case where the photoconductor drum is attached to the holding portion of the cleaning device frame without a film member.

FIG. 7 illustrates a case where the photoconductor drum 11 is attached to the holding portion 211 (see FIG. 4) of the cleaning device frame 21 without the film member 27. FIG. 7 is a sectional view corresponding to the sectional view illustrated in FIG. 6B that is taken along line VIB-VIB illustrated in FIG. 5. Since the sealant 20 has adhesiveness, the cleaning blade 22 adheres to the sealant 20. Therefore, if the height of the felt member 25 (the projection 250) from the cleaning device frame 21 is larger than the height of the edge 221 of the cleaning blade 22 from the cleaning device frame 21, the edge 221 of the cleaning blade 22 does not come into contact with the photoconductor drum 11 on the peripheral side B (and on the peripheral side C).

In such a case, toner residues collected in the recessed space may leak from a gap 22*a* produced between the edge 221 of the cleaning blade 22 and the photoconductor drum 11 on the peripheral side B (and on the peripheral side C). Moreover, since the pressure with which the edge 221 of the cleaning blade 22 is to be pressed against the photoconductor drum 11 is insufficient, cleaning failure may occur.

In the first exemplary embodiment, the film member 27 not having adhesiveness is interposed between the sealant 20 and the cleaning blade 22 on the peripheral side B (and on the peripheral side C). Therefore, although the sealant 20 has adhesiveness, the cleaning blade 22 does not adhere to the sealant 20 and is not held by the sealant 20. Hence, the edge 221 of the cleaning blade 22 is allowed to come into contact with the surface of the photoconductor drum 11. That is, the photoconductor drum 11 and the edge 221 of the cleaning blade 22 come into close contact with each other on the peripheral side B (and on the peripheral side C). Thus, the recessed space provided in the cleaning device frame 21 is tightly sealed.

Consequently, toner residues collected in the recessed space of the cleaning device frame 21 are prevented from leaking.

The above description concerns a case where the film member 27 is provided in the region α and the region β on the peripheral side B (and on the peripheral side C). To prevent the leakage of toner residues, the film member 27 only needs to be provided in the region β.

In the case where the film member 27 extends over the region β and the region α, the cleaning device frame 21 and the cleaning-blade-supporting plate 23 are prevented from adhering to each other in the region α. Therefore, when the cleaning device 2 that has been used is disassembled and the cleaning-blade-supporting plate 23 is detached from the cleaning device frame 21, the cleaning-blade-supporting plate 23 is easily detached from a portion where the cleaning device frame 21 and the cleaning-blade-supporting plate 23 do not adhere to each other with the presence of the film member 27 interposed therebetween.

The film member 27 only needs to have a low adhesiveness with respect to the sealant 20, which is made of thermoplastic elastomer or the like, and may be a film made of polyethylene, polypropylene, or the like.

Figure 8:
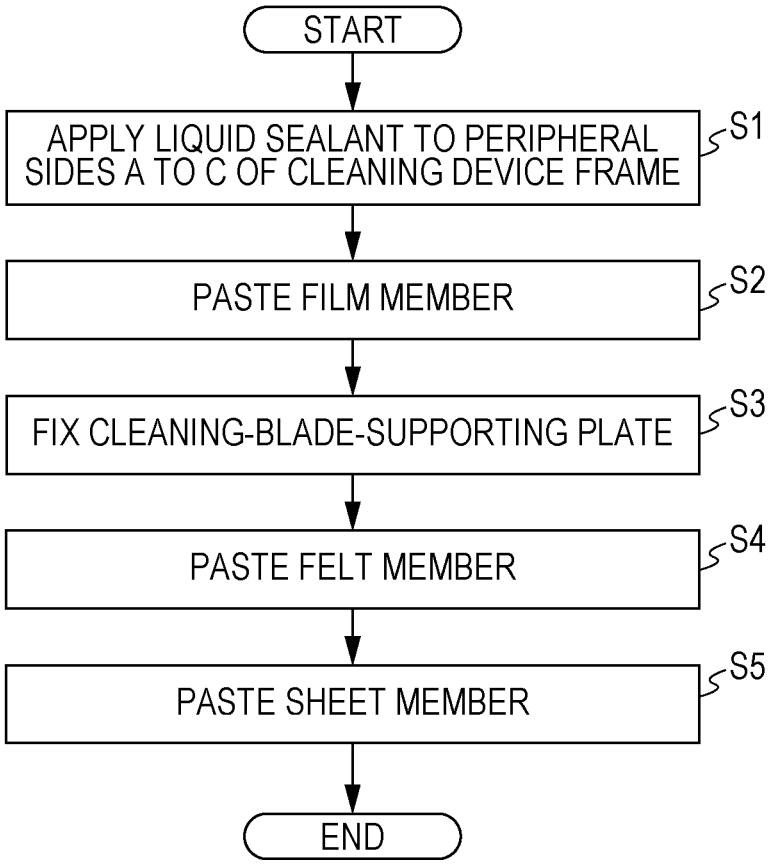
FIG. 8 is a flow chart illustrating a method of manufacturing the cleaning device according to the first exemplary embodiment.

FIG. 8 is a flow chart illustrating a method of manufacturing the cleaning device 2 according to the first exemplary embodiment.

In step S1, the sealant 20 is applied to the peripheral sides A, B, and C of the cleaning device frame 21. The sealant 20 is a liquid sealant such as thermoplastic elastomer. The sealant 20 is applied in a liquid state and is then solidified, thereby sealing any gaps produced between relevant members. The sealant 20 is ejected from a nozzle (syringe) to the peripheral sides A, B, and C of the cleaning device frame 21. In step S1, the application may be performed while the nozzle is moved under the control of a computer along the peripheral sides A, B, and C of the cleaning device frame 21 that is fixed, or while the cleaning device frame 21 is moved with the nozzle fixed.

The amount of sealant 20 to be ejected from the nozzle may be adjusted by controlling, for example, the pressure (pneumatic pressure) to be applied to the sealant 20 in the nozzle.

Subsequently, in step S2, the film member 27 is pasted to each of the peripheral side B and the peripheral side C of the cleaning device frame 21 that have the sealant 20.

Then, in step S3, the cleaning-blade-supporting plate 23 having the cleaning blade 22 bonded therewith is screwed and fixed to the cleaning device frame 21. In step S3, the peripheral side A, the peripheral side B, and the peripheral side C defining the inlet 210*a* are each partially covered by the cleaning-blade-supporting plate 23 supporting the cleaning blade 22. Accordingly, part of the inlet 210*a* is covered by the cleaning blade 22 and the cleaning-blade-supporting plate 23.

Furthermore, in step S4, the felt member 25 is pasted to a felt pasting surface 2103 of the cleaning device frame 21. When the photoconductor drum 11 is attached to the holding portion 211 of the cleaning device frame 21, the elastic layer 252 of the felt member 25 is squeezed. Therefore, the felt layer 251 comes into close contact with the photoconductor drum 11. In step S4, the projection 250 of the felt member 25 projects toward the longitudinal center of the cleaning device 2 with respect to the felt pasting surface 2103, and the side of the projection 250 of the felt member 25 and the side of the other portion of the felt member 25 that form an L shape comes into contact with the cleaning blade 22. Thus, toner residues are prevented from leaking via any gaps produced between the cleaning blade 22 and the felt member 25.

Furthermore, in step S5, the sheet member 24 is pasted to the peripheral side D of the cleaning device frame 21 with the double-sided adhesive tape 26. In step S5, the sealant 20 on the peripheral sides B and C is squeezed between the double-sided adhesive tape 26 and the peripheral sides B and C.

Thus, the cleaning device 2 is complete.

Subsequently, the photoconductor drum 11 is attached to the holding portion 211 of the cleaning device frame 21.

Second Exemplary Embodiment

In the first exemplary embodiment, the film member 27 is interposed between the sealant 20 and the combination of the cleaning blade 22 and the cleaning-blade-supporting plate 23 on each of the peripheral sides B and C of the cleaning device frame 21.

The film member 27 prevents the sealant 20 having adhesiveness and the cleaning blade 22 from adhering to each other. Thus, the edge 221 of the cleaning blade 22 comes into close contact with the photoconductor drum 11, preventing the leakage of toner residues from the recessed space.

In a second exemplary embodiment of the present invention, the cleaning blade 22 and the sealant 20 are prevented from adhering to each other with powder 28 sprayed between the sealant 20 and the combination of the cleaning blade 22 and the cleaning-blade-supporting plate 23 on the peripheral sides B and C of the cleaning device frame 21. The powder 28 is an exemplary adhesion preventing member and does not have adhesiveness or has low adhesiveness. Thus, the edge 221 of the cleaning blade 22 comes into close contact with the photoconductor drum 11, preventing the leakage of toner residues from the recessed space and the occurrence of cleaning failure due to insufficient pressure with which the edge 221 of the cleaning blade 22 comes into contact with the photoconductor drum 11.

Cleaning Device 2

Figure 9:
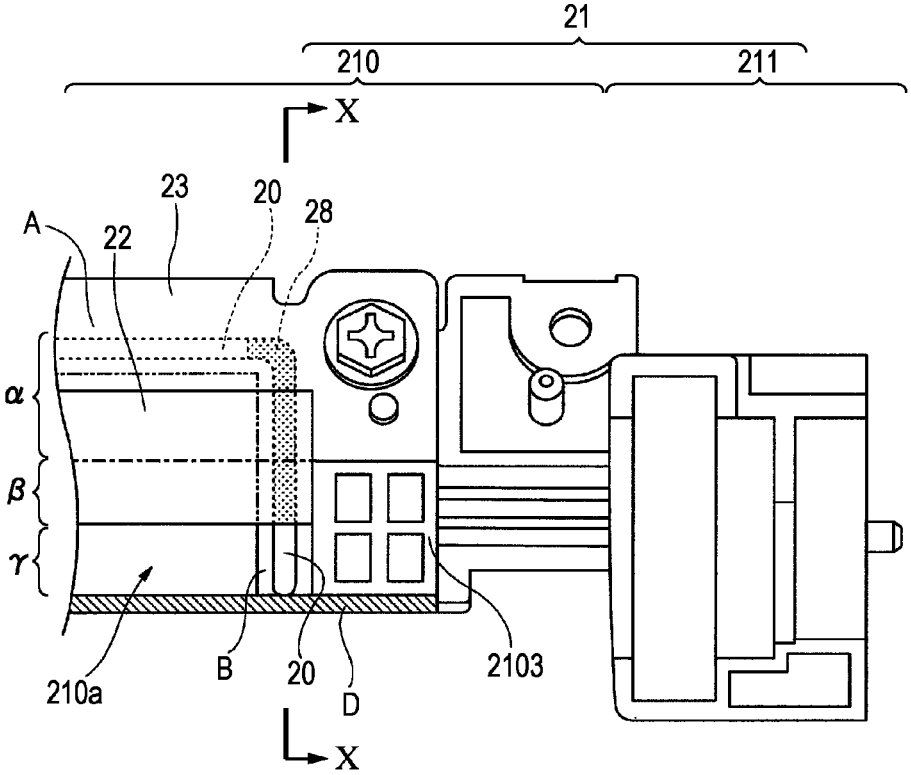
FIG. 9 is an enlarged view of a cleaning device according to a second exemplary embodiment of the present invention.

FIG. 9 is an enlarged view of the cleaning device 2 according to the second exemplary embodiment. In FIG. 9, the cleaning-blade-supporting plate 23 having the cleaning blade 22 bonded therewith is attached to the cleaning device frame 21. The edge of the inlet 210*a* of the cleaning device frame 21 that is behind the cleaning blade 22 and the cleaning-blade-supporting plate 23 is represented by a dash-dot-dot line. The edge of the cleaning-blade-supporting plate 23 that is behind the cleaning blade 22 is represented by a dash-dot line. A portion of the sealant 20 extending over the peripheral side A and the peripheral side B that is behind the cleaning blade 22 and the cleaning-blade-supporting plate 23 is represented by a dotted line. The powder 28 provided on the sealant 20 is represented by halftone dots.

The powder 28 is sprayed to a portion of the sealant 20 extending over the region α and the region β on the peripheral side B. The powder 28 may be particles of polymethyl methacrylate (PMMA) having sizes of 1 μm and smaller, for example, 100 nm to 200 nm.

The other details of the cleaning device 2 according to the second exemplary embodiment are the same as those of the cleaning device 2 according to the first exemplary embodiment illustrated in FIG. 5, and description thereof is therefore omitted.

Figure 10:
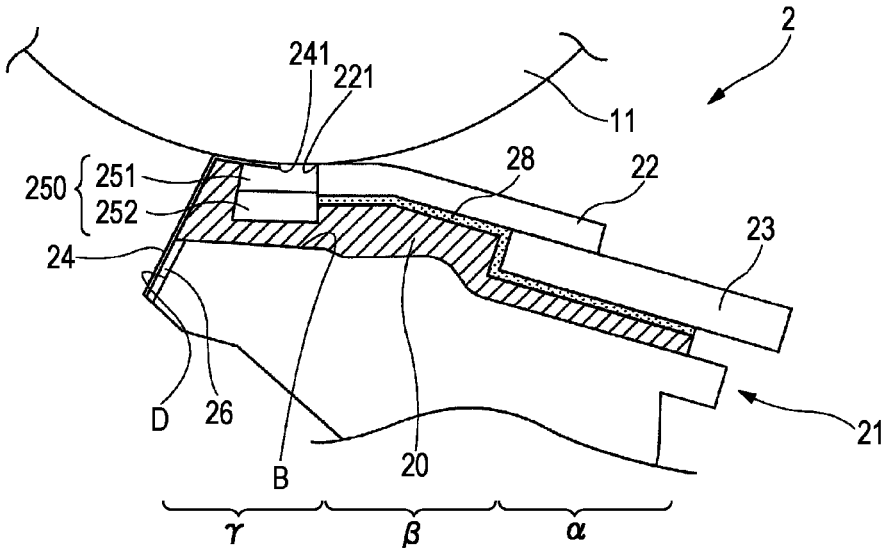
FIG. 10 illustrates a state where the photoconductor drum is attached to the holding portion of the cleaning device frame according to the second exemplary embodiment.

FIG. 10 illustrates a state where the photoconductor drum 11 is attached to the holding portion 211 (see FIG. 4) of the cleaning device frame 21 according to the second exemplary embodiment. FIG. 10 is a sectional view taken along line X-X illustrated in FIG. 9.

As illustrated in FIG. 10, the powder 28 is interposed between the cleaning blade 22 and the sealant 20 in the section taken along line X-X illustrated in FIG. 9, i.e., in a region where the cleaning blade 22 resides on the peripheral side B. Therefore, although the sealant 20 has adhesiveness, the cleaning blade 22 is prevented from adhering to the sealant 20 while the powder 28 adheres to the sealant 20. Hence, the cleaning blade 22 is pressed against the photoconductor drum 11 with its own elasticity, and the edge 221 of the cleaning blade 22 comes into contact with the photoconductor drum 11.

Such a configuration prevents the production of any gaps between the photoconductor drum 11 and the cleaning blade 22 and the leakage of toner residues via the gaps.

Figure 11:
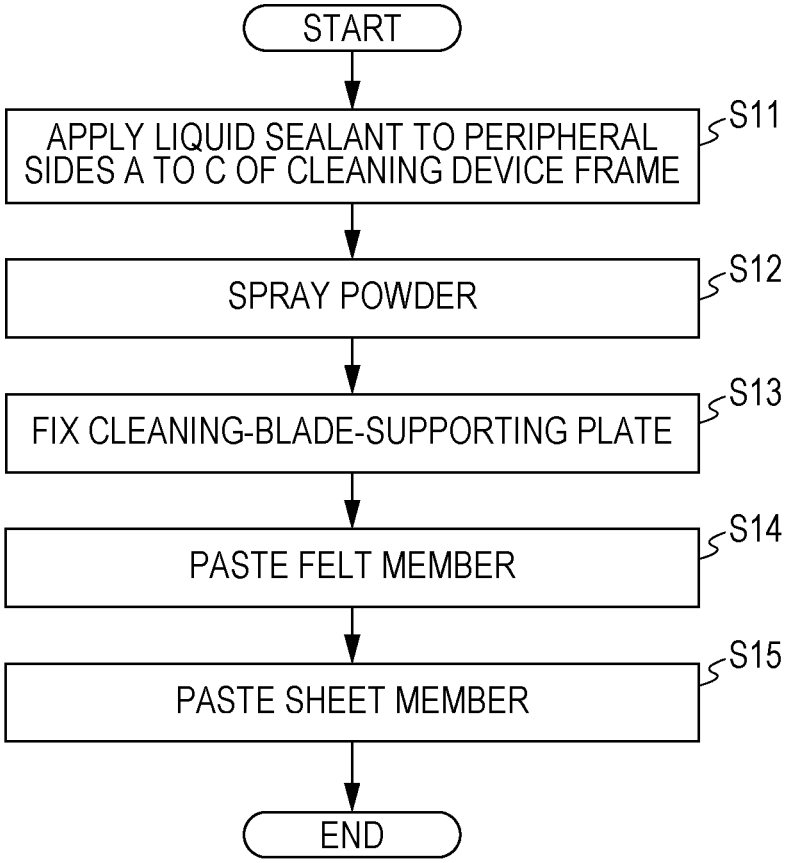
FIG. 11 is a flow chart illustrating a method of manufacturing the cleaning device according to the second exemplary embodiment.

FIG. 11 is a flow chart illustrating a method of manufacturing the cleaning device 2 according to the second exemplary embodiment. The method is the same as the method according to the first exemplary embodiment illustrated in FIG. 8 except step S12. Therefore, the same steps will be described only briefly.

In step S11, the sealant 20 is applied to the peripheral sides A, B, and C of the cleaning device frame 21.

Subsequently, in step S12, the powder 28 is sprayed to the portions of the sealant 20 on the peripheral side B and the peripheral side C of the cleaning device frame 21. The powder 28 contains particles of, for example, PMMA. The powder 28 is ejected from a nozzle (syringe) together with a gas such as air and is sprayed to the peripheral sides B and C of the cleaning device frame 21. In step S12, the spraying may be performed while the nozzle is moved under the control of a computer along the peripheral sides B and C of the cleaning device frame 21 that is fixed, or while the cleaning device frame 21 is moved with the nozzle fixed.

The amount of powder 28 to be sprayed from the nozzle may be adjusted by controlling, for example, the pressure (pneumatic pressure) to be applied to the powder 28 in the nozzle.

Subsequently, in step S13, the cleaning-blade-supporting plate 23 having the cleaning blade 22 bonded therewith is screwed and fixed to the cleaning device frame 21.

Furthermore, in step S14, the felt member 25 is pasted to the felt pasting surface 2103 of the cleaning device frame 21.

Furthermore, in step S15, the sheet member 24 is pasted to the peripheral side D of the cleaning device frame 21 with the double-sided adhesive tape 26. In step S15, the sealant 20 on the peripheral sides B and C is squeezed between the double-sided adhesive tape 26 and the peripheral sides B and C.

Thus, the cleaning device 2 is complete.

Subsequently, the photoconductor drum 11 is attached to the holding portion 211 of the cleaning device frame 21.

In the first exemplary embodiment, the film member 27 is pasted to each of the peripheral side B and the peripheral side C. In the second exemplary embodiment, the powder 28 is sprayed to each of the peripheral side B and the peripheral side C. The powder 28 may be mixed with compressed air or the like, and the mixture may be sprayed from a nozzle, as with the sealant 20. Such a spraying method is easily automated under the control of a computer.

While the above exemplary embodiments concern the cleaning device 2 that cleans the photoconductor drum 11, the present invention may also be applied to the intermediate-transfer-belt cleaner 35 that cleans the intermediate transfer belt 15. In that case, the cleaning device frame 21 does not necessarily include the holding portion 211 that holds the photoconductor drum 11.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a developer removing member that has a substantially long plate shape, one edge of the developer removing member that extends in a long-side direction coming into contact with a surface of an image carrier, the developer removing member removing developer residues from the surface of the image carrier while the image carrier is rotating in a short-side direction;

a supporting member that is in contact with a surface of the developer removing member opposite another surface of the developer removing member that faces the image carrier, the supporting member supporting the developer removing member in the long-side direction such that the developer removing member extends beyond the supporting member on a side thereof having the one edge;

a developer collecting member that has an opening, the opening being substantially long in the long-side direction with a smaller length in the long-side direction than the developer removing member, the developer collecting member being configured such that the one edge of the developer removing member is positioned in a central portion of the opening in the short-side direction and such that portions defining one edge of the opening extending in the long-side direction and two edges of the opening extending in the short-side direction, respectively, face a combination of the supporting member and the developer removing member, the developer collecting member collecting, via the opening, the developer residues that have been removed from the image carrier;

a sealing member that is provided between the combination of the supporting member and the developer removing member and the portions defining the one edge of the opening extending in the long-side direction and the two edges of the opening extending in the short-side direction, the sealing member sealing any gaps produced therebetween; and an adhesion preventing member provided in each of the portions defining the two respective edges of the opening extending in the short-side direction, the adhesion preventing member being interposed between the sealing member and the developer removing member and preventing the developer removing member and the sealing member from adhering to each other.

2. The cleaning device according to claim 1, wherein, in the portions defining the two edges of the opening extending in the short-side direction, the adhesion preventing member extends between the supporting member and the sealing member.

3. The cleaning device according to claim 1, wherein the adhesion preventing member is a flexible film and is interposed between the sealing member and the developer removing member or the supporting member in such a manner as to seal any gaps produced therebetween, the adhesion preventing member allowing the one edge of the developer removing member to come into contact with the image carrier while preventing the developer removing member and the sealing member from adhering to each other.

4. The cleaning device according to claim 1, wherein the adhesion preventing member is powder and is provided over the sealing member and between the sealing member and the developer removing member or the supporting member in such a manner as to seal any gaps produced therebetween, the adhesion preventing member allowing the one edge of the developer removing member to come into contact with the image carrier while preventing the developer removing member and the sealing member from adhering to each other.

5. An image forming apparatus comprising:

an image carrier;

a charging member that charges the image carrier;

an exposure member that exposes the image carrier to light and forms an electrostatic latent image on the image carrier;

a development member that develops the electrostatic latent image on the image carrier with developer;

a cleaning member that removes developer residues from the image carrier; and a transfer member that transfers the image developed on the image carrier to a recording material, wherein the cleaning member includes a developer removing member that has a substantially long plate shape, one edge of the developer removing member that extends in a long-side direction coming into contact with a surface of the image carrier, the developer removing member removing developer residues from the surface of the image carrier while the image carrier is rotating in a short-side direction;

a supporting member that is in contact with a surface of the developer removing member opposite another surface of the developer removing member that faces the image carrier, the supporting member supporting the developer removing member in the long-side direction such that the developer removing member extends beyond the supporting member on a side thereof having the one edge;

a developer collecting member that has an opening, the opening being substantially long in the long-side direction with a smaller length in the long-side direction than the developer removing member, the developer collecting member being configured such that the one edge of the developer removing member is positioned in a central portion of the opening in the short-side direction and such that portions defining one edge of the opening extending in the long-side direction and two edges of the opening extending in the short-side direction, respectively, face a combination of the supporting member and the developer removing member, the developer collecting member collecting, via the opening, the developer residues that have been removed from the image carrier;

a sealing member that is provided between the combination of the supporting member and the developer removing member and the portions defining the one edge of the opening extending in the long-side direction and the two edges of the opening extending in the short-side direction, the sealing member sealing any gaps produced therebetween; and an adhesion preventing member provided in each of the portions defining the two respective edges of the opening extending in the short-side direction, the adhesion preventing member being interposed between the sealing member and the developer removing member and preventing the developer removing member and the sealing member from adhering to each other.

* * * * *